US005094540A

United States Patent [19]

Face, Jr.

[11] Patent Number: 5,094,540

[45] Date of Patent: Mar. 10, 1992

[54] SEALED MIXER PADDLE SHAFT ASSEMBLY

[76] Inventor: Samuel A. Face, Jr., 1008 Magnolia Ave., Norfolk, Va. 23508

[21] Appl. No.: 683,787

[22] Filed: Apr. 11, 1991

[51] Int. Cl.[5] ..... B28C 5/14; B28C 7/16

[52] U.S. Cl. ..... 366/46; 366/64; 366/185; 366/194

[58] Field of Search ..... 366/45, 46, 47, 48, 366/64, 66, 279, 308, 50, 185, 189, 194, 195, 196

[56] References Cited

U.S. PATENT DOCUMENTS

| | | | |
|---|---|---|---|
| 2,970,820 | 2/1961 | Sepich | 366/47 |
| 4,097,926 | 6/1978 | Face | 366/47 |
| 4,509,860 | 4/1985 | Lasar | 366/185 |
| 4,877,327 | 10/1989 | Whiteman | 366/47 |

*Primary Examiner*—Robert W. Jenkins

*Attorney, Agent, or Firm*—Fleit, Jacobson, Cohn, Price, Holman & Stern

[57] ABSTRACT

A paddle shaft assembly for a mixing apparatus including a quickly and easily removable quill shaft provided with a unique seal structure associated with the shaft and a unique mounting and handle structure to enable disassembly of the shaft in relation to a mixer drum and paddle assembly in the drum. The removable shaft is provided with a flanged end plate having keyhole slot connections to a flange on the end of a rotatable sleeve sealed in relation to the drum for removably supporting the shaft and a loop type handle attached to the end plate to facilitate manipulation of the end plate and shaft to remove and replace the shaft. A seal assembly is associated with the shaft, rotatable sleeve, end plate and flange to seal those areas of the shaft and sleeve to preclude passage of the material being mixed into the area between the shaft and rotatable sleeve, and between the flange and end plate.

11 Claims, 1 Drawing Sheet

SEALED MIXER PADDLE SHAFT ASSEMBLY

BACKGROUND OF THE INVENTION

1. Field of the Invention

The present invention relates to a paddle shaft assembly for a mixing apparatus including a quickly and easily removable quill shaft provided with a unique seal structure associated with the shaft and a unique mounting and handle structure to enable disassembly of the shaft in relation to a mixer drum and paddle assembly in the drum. The removable shaft is provided with a flanged end plate having keyhole slot connections to a flange on the end of a rotatable sleeve sealed in relation to the drum for removably supporting the shaft and a loop type handle attached to the end plate to facilitate manipulation of the end plate and shaft to remove and replace the shaft. A seal assembly is associated with the shaft, rotatable sleeve, end plate and flange to seal those areas of the shaft and sleeve to preclude passage of the material being mixed into the area between the shaft and rotatable sleeve, and between the flange and end plate.

2. Description of the Prior Art

U.S. Pat. No. 4,097,926 issued June 27, 1978 for Mixer Paddle Shaft Assembly discloses a shaft assembly associated with rotating mixing paddles within a horizontal drum-type mixer which enables the paddles to be easily removed by sliding out a supporting shaft without disassembly of support bearings and other structure related to the shaft and mixing paddles. However, while a seal structure was provided between the drum and a rotatable sleeve through which the shaft was inserted, this structure could permit entry of the material being mixed between the shaft and sleeve by such material migrating to the outer end of the sleeve and between the flange on the sleeve and an end plate on the shaft which connected the sleeve to the shaft. The structure disclosed in this patent has been materially improved by providing a unique keyhole slot connection between the end plate on the end of the shaft and the flange on the sleeve, by providing a handle on the end plate on the shaft and seal structures associated with the sleeve and shaft and with the end plate on the shaft and the flange on the sleeve. The above mentioned patent does not include these features.

SUMMARY OF THE INVENTION

An object of the present invention is to provide a paddle shaft assembly for a mixing apparatus to enable removal of paddle shafts from a horizontal drum mixer in which the shaft is provided with an end plate releasably connected to an end flange on a rotatable supporting sleeve by a keyhole slot connection with the flange on the end of the sleeve including a lubricant fitting to enable sealing lubricant to enter the space between the rotatable sleeve and shaft which extends therethrough.

Another object of the invention is to provide a mixer paddle assembly in which seals are provided between the shaft and sleeve to preclude entry of the material being mixed into the area between the rotatable sleeve and shaft.

Still another object of the invention is to provide an end plate on the shaft of the assembly defined in the preceding objects with keyhole slots to receive headed bolts connected with the end flange on the sleeve to facilitate easy and quick removal and installation of the shaft with the end plate on the end of the shaft including a rigid loop-type handle extending axially therefrom to facilitate handling and manipulation of the shaft during use.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
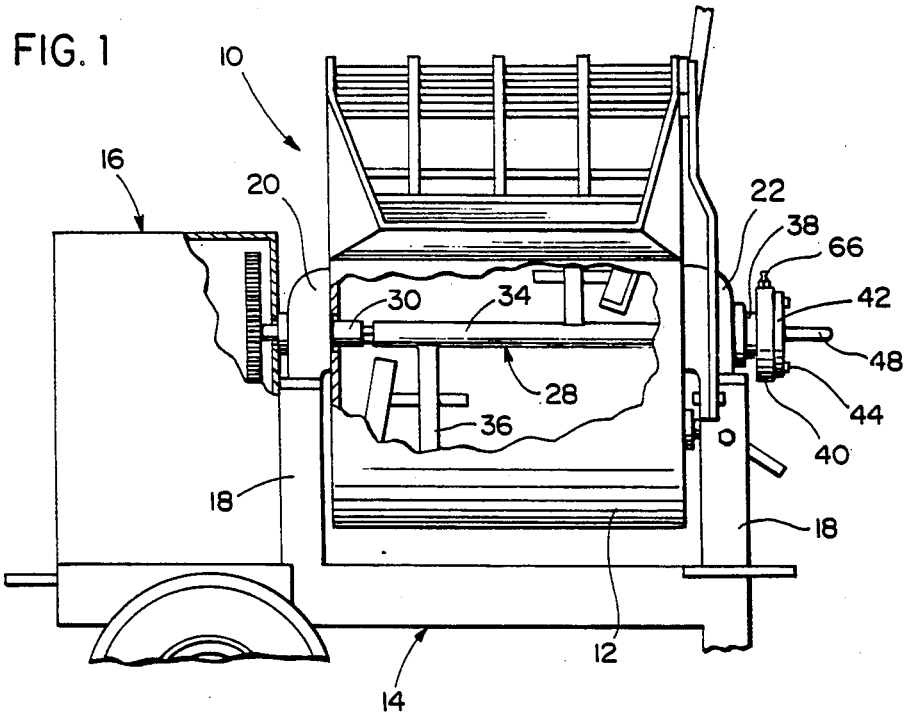
FIG. 1 is an elevational view, with portions in section, of a mixer with the paddle shaft assembly of the present invention incorporated therein.
Figure 2:
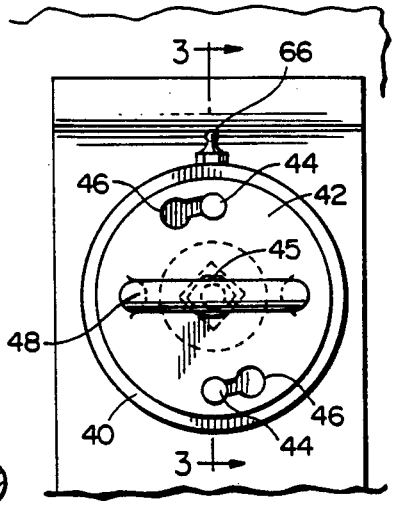
FIG. 2 is an end elevational view of the shaft illustrating the keyhole-shaped apertures and handle to facilitate rotational movement of the shaft and removal and insertion of the shaft.

FIG. 1 of the drawings illustrates a mixer 10 similar to that disclosed in U.S. Pat. No. 4,097,926 and which includes a generally horizontally disposed mixing drum 12 supported by a frame 14 and provided with a drive unit 16. The drum 12 is pivotally supported by pedestals 18 at each end thereof and the drum includes shell housings 20 and 22 at each end thereof which support the drum from the pedestals 18 with the shells 20 and 22 enclosing a seal assembly 24 and a bearing assembly 28 all as disclosed in U.S. Pat. No. 4,097,926. A paddle and shaft assembly generally designated by reference numeral 28 is positioned within the drum which includes a short driven stub shaft 30 having a square or polygonal socket therein receiving the end of an elongated square or polygonal quill shaft 32 which has one end telescoped into the socket in the stub shaft 30 thereby drivingly connecting the quill shaft 32 to the stub shaft 30. The paddle and shaft assembly 28 also includes a tubular shaft 34 which has a square or polygonal interior slidably receiving the quill shaft 32 thereby driving tubular shaft 34. The tubular shaft 34 includes a plurality of paddles 36 mounted thereon in a conventional manner. As illustrated, the tubular shaft 34 is independent of the stub shaft 30 and also is independent of a rotatable cylindrical sleeve 38 slidably receiving and being driven by the quill shaft 32 which extends through the shell 22 and the seal assembly 24 therein and the bearing assembly 26 associated therewith. The external surface of the cylindrical sleeve 38 is rotatable in relation to the seal assembly 24 and bearing assembly 26 and the sleeve 38 rotates with the end of the quill shaft 32 by virtue of the square interior of the sleeve 38 engaging the square exterior of the quill shaft 32 and by the use of a peripheral flange 40 on the end of the sleeve 38 being engaged by a circular end plate 42 mounted on the end of the quill shaft 32 and detachably secured to the flange 40 by headed studs 44 on the flange 40 which are received through keyhole slots 46 formed in the end plate 42. A center bolt 47 fixedly attaches the plate 42 to the end of the quill shaft 32.

Attached to the outer surface of the plate 42 is a generally U-shaped or loop-type handle 48 which extends diametrically of the plate 42 generally between the headed studs 44 which are received in the keyhole slots 46. The handle 48 enables the plate 42 to be angularly displaced or twisted in relation to the flange 40 and in relation to the quill shaft 32 and sleeve 38 when the fastening bolt 46 has been loosened thus enabling separation of the plate 42 from the flange 40 when the headed ends of the studs 44 are aligned with the large portion of the keyhole slots 46 which will enable the plate 42 to move axially outwardly away from the flange 40 thus retracting the quill shaft 32 axially through the sleeve 38 thus removing the quill shaft from engagement with the stub shaft 30 and removing the quill shaft from the tubular shaft 34 to enable the paddles 36 and tubular shaft 34 to be removed from the drum for cleaning, repair, replacement and the like.

Figure 3:
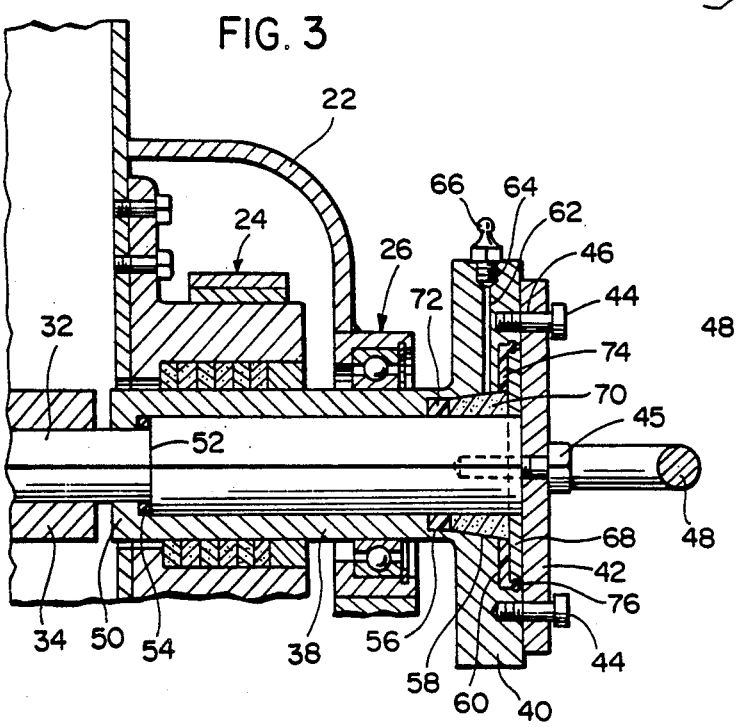
FIG. 3 is a detailed sectional view illustrating further structural details of the shaft and sleeve including the positioning of seals therebetween.

As illustrated in FIG. 3, the inner end of the sleeve 38 is provided with an inwardly extending peripheral flange 50 positioned inwardly of a peripheral shoulder 52 formed on the quill shaft 32 which is normally in spaced opposed relation to the inner surface of the peripheral flange 50. An O-ring seal 54 of square configuration is positioned between the shoulder 52 and an opposed shoulder defined by the inner surface of the peripheral flange 50 to form a seal to prevent leakage of material being mixed between the quill shaft 32 and the interior of the sleeve 38.

The outer end of the sleeve 38 includes a peripheral recess 56 which merges with and forms a continuation of a generally frustroconical recess 58 in the interior of the flange 40. The outer end surface of the flange 40 is provided with a shallow recess 60 and a radial passageway 62 extends from the recess 58 to the periphery of the flange 40 and terminates in an internally threaded enlargement 64 receiving a lubricant fitting 66 by which a pressure lubricant gun can inject lubricant or sealant through a passageway 62 into the cavity or recess 58. Positioned in the recess 60 is a plate or panel 68 and positioned in the recess 58 is a frustroconical member 70 which conforms with and engages the external surface of the quill shaft 32 and the internal surface of the recess 50 with the panel 68 and the member 70 being constructed of lubricant absorbing felt-like material which forms a cushion and sealant for the shaft. The recess 58 in the sleeve 38 is provided with an O-ring seal 72. A flat annular disc seal 74 is positioned between the plate or panel 68 and the inner surface of the recess 60 and an O-ring seal 76 is positioned between the periphery of the plate or panel 68 and the interior periphery of the recess 60 as illustrated in FIG. 3 thus providing additional seals for the shaft and sleeve. The O-ring seal 54 may be of circular cross-sectional configuration but is generally is overall square or polygonal to conform with the shape and size of the exterior surface of the shaft 32 and the interior surface of the sleeve 38. Likewise, the seal 72 is shaped in a similar manner and the member 70 may also be of a similar shape with the interior and exterior thereof conforming with the square shaft and square recesses.

The quill shaft and flange arrangement including the keyhole slots 46 and handle 48 facilitate removal and replacement of the paddle and shaft assembly which reduces the possibility of injury which can occur when individuals are caught in the paddle assembly as they have tried to clean the paddle assembly while still located in the drum when a drive clutch was accidentally engaged. The seal arrangement prevents leakage of the material being mixed through the interface between the quill shaft 32 and the sleeve 38. This is especially helpful when the mixed product is in the form of a wet slurry having a large proportion of water or other liquid. While seals have been shown at various positions in FIG. 3, it is pointed out that the seal arrangement can be modified by omitting seals at certain of the sites depending upon the seal capabilities required. For example, the assembly could be provided with the seal 72 and none others or the seal 60 and none others, or with the seal 76 and none others or the flat disc seal 74 could be in the form of an O-ring seal between the opposed surfaces of the plate 68 and the recess 60. Likewise, the seal 56 and the seal 76 could be utilized without the seal 60 or the seal 60 and seal 76 could be utilized without the seal 56. Preferably, the seal 54 will always be used to provide at least a double seal arrangement. If a cylindrical shaft segment is provided on the quill shaft as in U.S. Pat. No. 4,097,926, the mating surfaces between the flange 88 and flange 92 in that patent would be provided with an O-ring or a flat disc seal and the interior of the sleeve 86 and the exterior of the shaft 74 in that patent could be provided with an O-ring seal with the various seal arrangements preventing leakage of water or the water content of a material being mixed from leaking between the sleeve and quill shaft and preventing any material from leaking through the end of the quill shaft and sleeve assembly to the exterior of the mixer shell 22.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In a mixing apparatus having a supported drum for receiving materials to be mixed and a driven paddle shaft assembly within the drum driven by power means in which the paddle shaft assembly includes a quill shaft positioned in the drum with one end extending externally thereof and the other end including means releasably connected with the power means with the paddle shaft assembly including a hollow shaft with paddles thereon receiving the quill shaft and being driven by the quill shaft and means oriented externally of the drum to maintain the quill shaft in connecting relation to the power means with the retaining means being releasable to allow the quill shaft to be withdrawn from the interior of the drum, the improvement comprising seal means operatively associated between the quill shaft and drum to prevent leakage of material being mixed between the drum and quill shaft, said seal means comprising a sleeve extending longitudinally of the quill shaft where it exists from the drum with the sleeve including a cylindrical external surface engaged by a seal, said sleeve and quill shaft having interfacing surfaces interiorally of the sleeve and a seal assembly in the interface to prevent leakage of material being mixed along the interface.

2. The structure as defined in claim 1 wherein said interface includes a square interior surface on the sleeve and a square exterior surface on the quill shaft, said quill shaft including a radially disposed shoulder, said sleeve including an inturned flange on the end thereof adjacent the drum, said seal assembly including an annular seal ring positioned between and engaging the shoulder on the quill shaft and the interior axial surface on the inturned end flange on the sleeve.

3. The structure as defined in claim 1 wherein said seal assembly includes an O-ring in the interface between the sleeve and quill shaft.

4. The structure as defined in claim 1 wherein said seal assembly includes a recess in the sleeve at the outer end thereof and a conical seal member in the recess engaging the quill shaft.

5. The structure as defined in claim 1 wherein said retaining means includes a flange on the outer end of the sleeve, an end plate on the outer end of the quill shaft disposed externally against the flange on the sleeve and means releasably interconnecting the flange and end plate to enable the end plate on the quill shaft to be separated from the flange on the sleeve to enable axial movement of the quill shaft out of the tubular shaft and drum.

6. The structure as defined in claim 5 wherein said means releasably securing the end plate to the flange includes a pair of diametrically opposed keyhole slots in the end plate on the quill shaft and headed studs received through the keyhole slots and connected with the flange on the sleeve to enable assembly and disassembly of the quill shaft.

7. The structure as defined in claim 6 together with a generally U-shaped handle rigidly affixed to the end plate on the quill shaft to facilitate the quill shaft being partially rotated in relation to the flange on the sleeve to enable release of the quill shaft from the sleeve.

8. The structure as defined in claim 7 wherein said seal assembly includes a disc seal between the flange and end plate.

9. The structure as defined in claim 7 wherein said seal assembly includes an O-ring seal between the flange and end plate.

10. The structure as defined in claim 9 wherein the flange on the sleeve includes an axial recess communicating with the outer end thereof, a sealing plate mounted in the recess with a flat disc seal between the plate and axial surface of the recess.

11. The structure as defined in claim 10 wherein said seal assembly includes an O-ring in the interface between the sleeve and quill shaft.

* * * * *